US005913706A

United States Patent [19]

Glickman et al.

[11] Patent Number: 5,913,706

[45] **Date of Patent: *Jun. 22, 1999**

[54] ARTICULATED SECTIONAL TOY FIGURE

[75] Inventors: Joel I. Glickman, Huntingdon Valley; Matthew Dickinson, Hatfield; Robert Gleim, Royersford; John Zimmer, Lansdale, all of Pa.

[73] Assignee: Connector Set Limited Partnership, Hatfield, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,003

[22] Filed: Jan. 3, 1997

[51] Int. Cl.[6] ..... A63H 3/16; A63H 33/06

[52] U.S. Cl. ..... 446/97; 446/99; 446/120

[58] Field of Search ..... 446/97, 99, 120, 446/381, 383, 101, 102, 379, 384, 104

[56] References Cited

U.S. PATENT DOCUMENTS

| | | | |
|---|---|---|---|
| D. 308,553 | 6/1990 | Canavesi . | |
| 1,746,839 | 2/1930 | Main et al. . | |
| 1,868,049 | 7/1932 | Deichmann . | |
| 2,623,329 | 12/1952 | Leva | 446/383 |
| 2,662,335 | 12/1953 | Calverley . | |
| 2,752,726 | 7/1956 | Calverley | 446/99 |
| 3,648,404 | 3/1972 | Ogsbury et al. | 446/102 |
| 4,103,451 | 8/1978 | Kawada et al. | 446/383 |
| 4,274,224 | 6/1981 | Pugh et al. . | |
| 4,680,019 | 7/1987 | Baerenwald et al. . | |
| 4,790,789 | 12/1988 | Mathis . | |
| 4,968,282 | 11/1990 | Robson et al. . | |
| 4,988,324 | 1/1991 | Ryaa et al. . | |
| 5,044,960 | 9/1991 | De Porteous . | |
| 5,350,331 | 9/1994 | Glickman | 446/126 |
| 5,456,625 | 10/1995 | Dumond . | |
| 5,752,869 | 5/1998 | Huff | 446/102 |

FOREIGN PATENT DOCUMENTS

| | | | |
|---|---|---|---|
| 2748677 | 5/1979 | Germany | 446/97 |
| 92169 | 12/1921 | Switzerland | 446/99 |

*Primary Examiner*—Robert A. Hafer
*Assistant Examiner*—Laura Fossum
*Attorney, Agent, or Firm*—Schweitzer Cornman Gross & Bondell LLP

[57] ABSTRACT

A sectional toy action figure is constructed of snap-together plastic components, characterized by the fact that an action figure may be assembled in a large variety of sizes and configurations, using a limited variety of individual components. Arms and legs may be configured in life-like orientations with connector elements providing for ball and socket connections at one end and a rod socket at the other. An additional terminal connector, comprising a ball socket at one end and a rod-like post at the other, is combinable with the before mentioned connector elements. Significant variety in sizing and configuring of the action figure is made possible by the ability to join said connector elements to each other by a connector rod, and to join a connector element with a terminal connector. The action figure also includes a head structure formed of layer-like sections mountable on a rod in a variety of configurations and orientations, enlarging the variety or forms in which the action figure may be constructed, using a minimum number of component parts.

5 Claims, 11 Drawing Sheets

ARTICULATED SECTIONAL TOY FIGURE

RELATED CASES

Certain aspects of the present invention incorporate subject matter of one or more of U.S. Pat. Nos. 5,061,219, 5,137,486, 5,199,919 and/or 5,350,331, owned by K'NEX Industries, Inc., Hatfield Pa., USA.

BACKGROUND AND SUMMARY OF THE INVENTION

The present invention relates to construction toys, and more particularly to an articulated, sectional figure, for example, a robot-like figure, which can be assembled in a variety of forms from a kit of parts. The invention is characterized particularly by a novel combination of a minimum number of plastic, snap-together parts form which a sectional toy figure, comprising a torso, articulated limbs and a head, may be constructed in a wide variety of configurations. Sectional toy figures, comprised of a torso, head and articulated limbs, are of course well known in a general sense. Earlier U.S. Pat. Nos. 1,746,839 to Main et al., and No. 2,662,335, to Calverly are typical. These known devices include snap-together parts, from which figures may be assembled in different sizes and configurations. Nevertheless, the design of the component parts is such as to impose significant limitations on the structural variety that may be achieved by the builder with a given set of parts.

In accordance with one aspect of the present invention, a novel sectional toy figure is provided in which the sectional limbs are constructed in a variety of sizes and configurations using a total of four standard parts arranged for snap-together assembly in a wide variety of combinations, providing both articulated and non-articulated joints in a manner enabling the widest variety of assembled configurations in relation to the number of different parts required.

In accordance with another aspect of the invention a novel and improved form of sectional toy figure is provided in which a head form is comprised of a plurality of layered sections, capable of assembly in various orders and orientations, providing a wide variety of head configurations in relation to the number of parts required.

In a particularly preferred form of the invention, the various component parts are injection molded of structural plastic materials, providing a torso section with sites for articulated connections at the shoulder and hip. Assembled arm and leg elements are comprised of standaridized, snap-together component elements of plastic material. Desirably, the arms and legs of the sectional figure are assembled from the same standard components, minimizing the parts requirements of a kit of parts, but at the same time enabling the arm elements to be configured to have an "arm" appearance, unlike the leg elements, and vice versa. The features of the invention enable a suitable kit of parts to be manufactured and marketed on a highly economical basis appropriately suited for the purposes intended.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
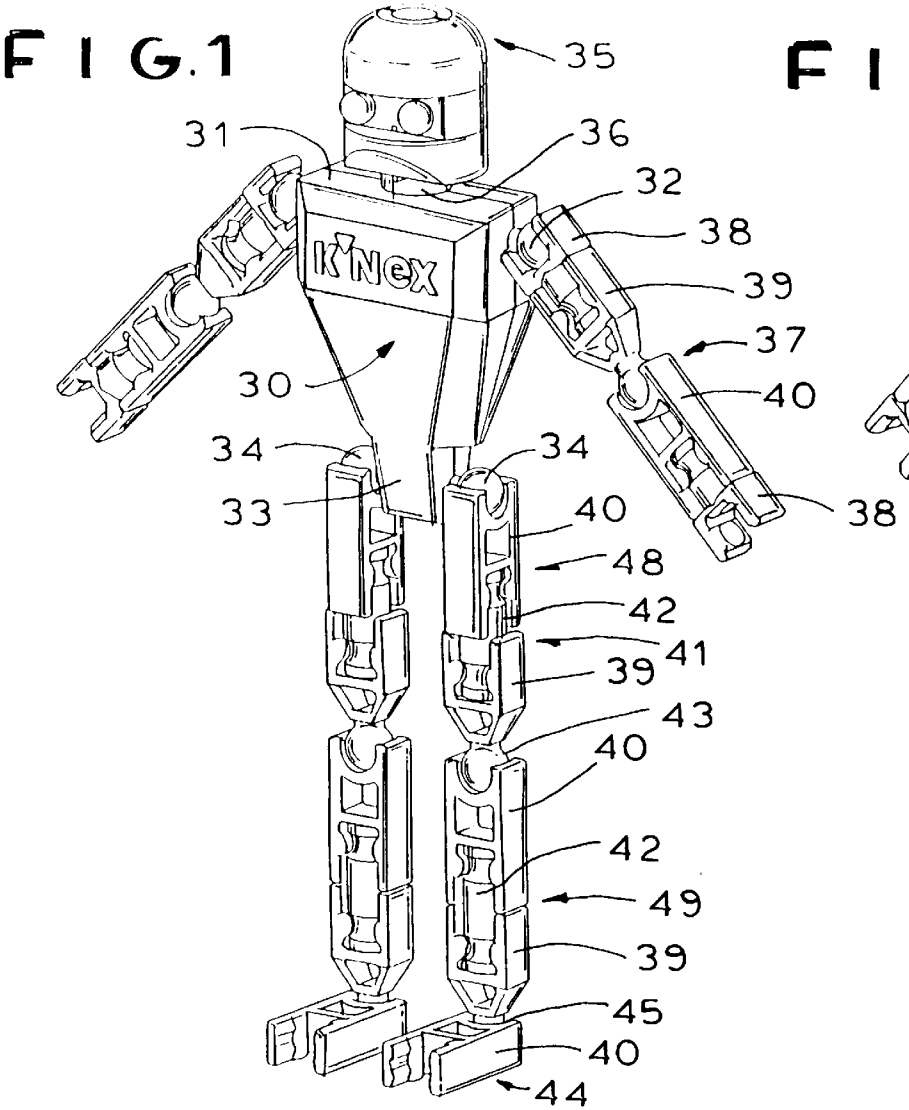
FIG. 1 is a front perspective view of one preferred form of sectional toy figure constructed and assembled in accordance with the invention with a "tall" configuration.

With reference initially to FIG. 1 of the drawing, showing the assembly of a "tall" sectional toy figure, the reference numeral 30 designates generally a torso or body element, which is provided at in a should area 31 with opposed joint-forming balls 32 and in the hip or pelvis area 33 with oppose joint-forming balls 34. A head assembly 35, to be described in greater detail, is mounted to a neck portion 36 of the body element and is rotatably adjustable thereon, as will be further described.

In the form of the invention illustrated in FIG. 1, an arm assembly, generally designated by the numeral 37, is comprised of a terminal connector 38 joined axially with a ball connector 39. The ball connector 39 is in turn joined with a socket connector 40, forming a swivel connection with the ball connector. At its outer end, the socket connector 40 is joined with a terminal connector 38. The terminal connector 38, the ball connector 39 and the socket connector 40 all will be described in greater detail hereinafter. In the illustrated arm assembly 37, the upper terminal connector 38 forms a shoulder joint with the ball 32. The ball connector 39 forms an upper arm, the socket connector 40 forms a forearm, and the lower terminal connector 38 represents a hand. The swivel connection between the ball and socket connectors 39, 40 forms an elbow joint.

The toy figure illustrated in FIG. 1 includes a leg assembly, designated generally by the numeral 41. The upper portion 48 of the leg assembly is comprised of a socket connector 40 joined with the ball 34 to form a swivel joint at the hip. A ball connector 39 is joined in an end-to-end axially aligned relation to the socket connector 40 by means of a short connecting rod 42. As will be described further, the connecting rod 42 is designed for a lateral snap-together assembly with the respective ball and socket connector elements. A lower portion 49 of the leg assembly 41 is also comprised of a socket connector 40, a ball connector 39 and a short connecting rod 42. In this illustrated form of the invention, the socket connector of the lower leg portion 49 is joined with the ball connector of the upper leg portion 48 to form a knee joint 43. A foot appendage 44 is formed by yet another socket connector 40 joined with the ball connector 39 of the lower leg at an ankle joint 45.

The various component elements forming the arm and leg assemblies advantageously are formed by injection molding of structural plastic material having at least a limited degree of resilience, such that the parts may be joined by snap-fit assembly, with the respective parts being dimensioned such that, after assembly, there is snug friction fit therebetween. This allows the various parts to be set in various positions and orientations and to retain such positions and orientations until reset by the user. A suitable commercially available structural plastic material which can usefully be employed in the manufacture of the component parts, is a material such as Celcon, available from Hoechst Celanese.

Figure 2:
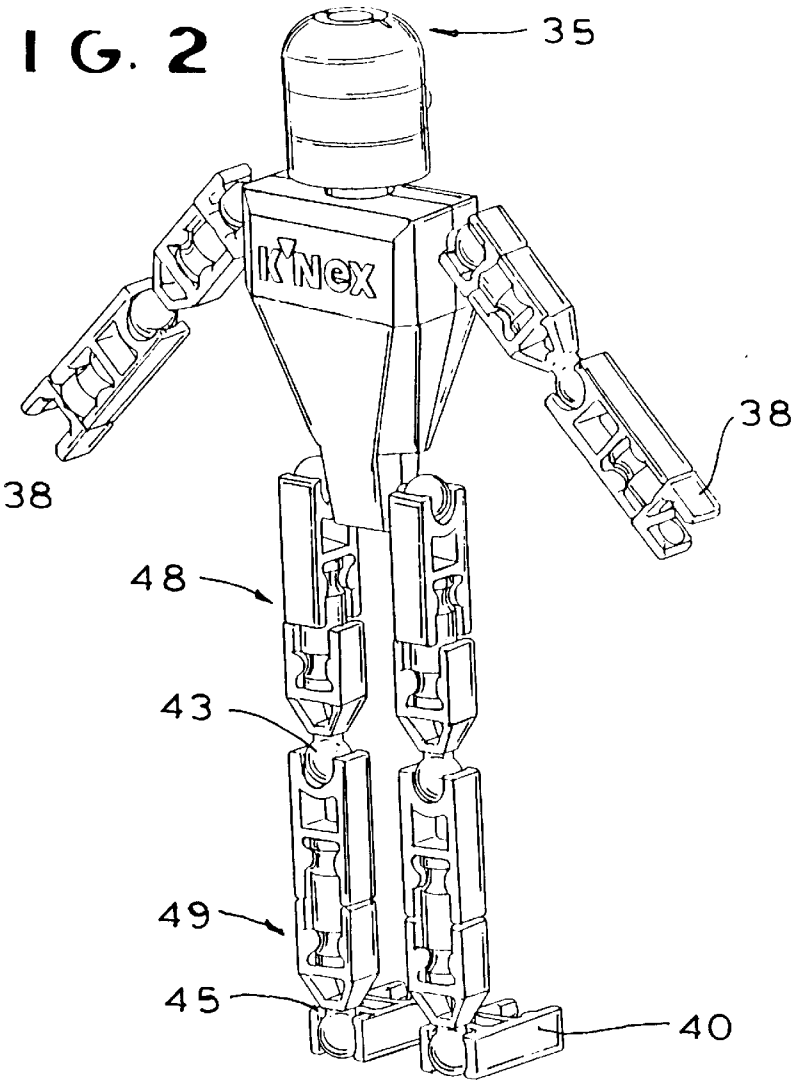
FIG. 2 is a back perspective view of the sectional toy figure of FIG. 1.
Figure 3:
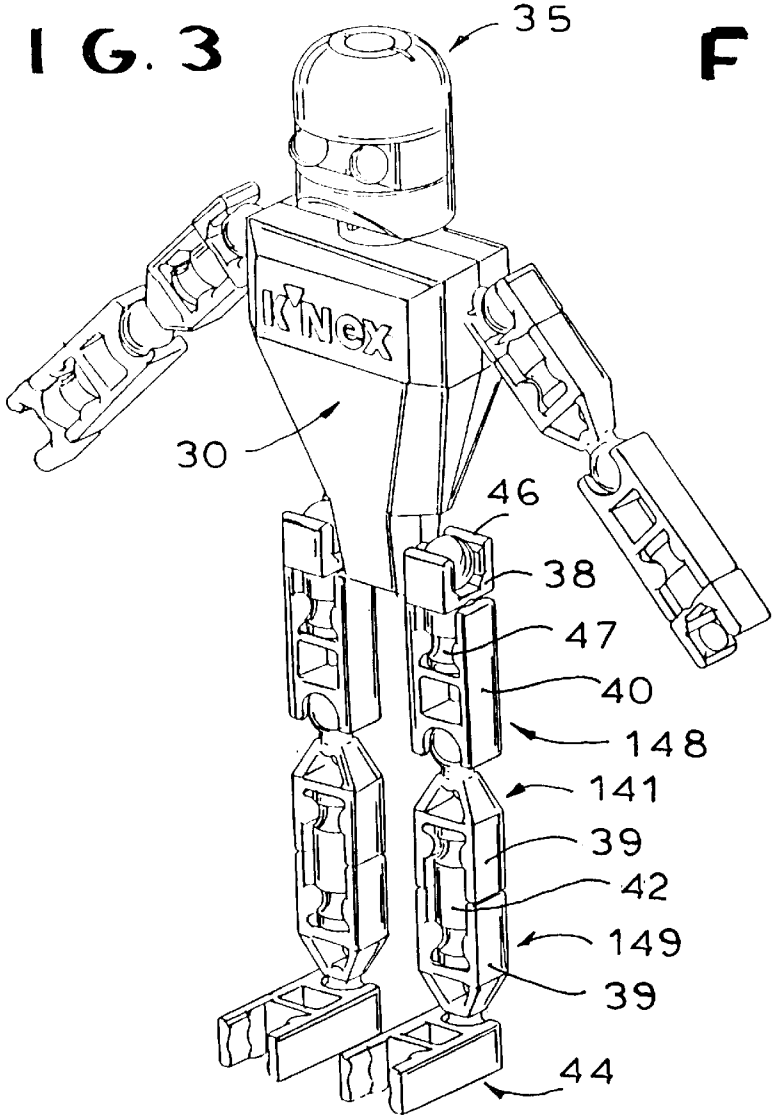
FIG. 3 is a front perspective view of a modified form of toy figure, similar to that of FIG. 1 for a "medium" configuration.

Pursuant to the invention, the toy figure may be assembled in a variety of configurations utilizing various combinations of the basic elements described above for construction of the arm and leg assemblies. By way of example but not of limitation, FIGS. 1–4 illustrate an assembly of the toy figure in three heights, "tall", "medium" and "short". To construct a figure of medium height, as shown in FIG. 3 of the drawings, the leg assembly 141 is constructed in the following manner The hip joint 46 is formed with a terminal connector 38, instead of the socket connector 40 utilized in the version of FIG. 1. The terminal connector has a rod end 47 joined in axial alignment with a socket connector 40 to form an upper leg assembly 148, which is shorter than the upper leg assembly 48 of FIG. 1 by reason of the terminal connector 38 being of shorter length than the socket connector 40 utilized in FIG. 1. The lower leg assembly 149 of FIG. 3, while being generally of the same length as the lower leg assembly 49 of FIG. 1, is comprised of two ball connector elements 39 assembled in end-to-end axial alignment by a connecting rod 42. The foot structure 44 is the same as in the embodiment of FIG. 1.

Figure 4:
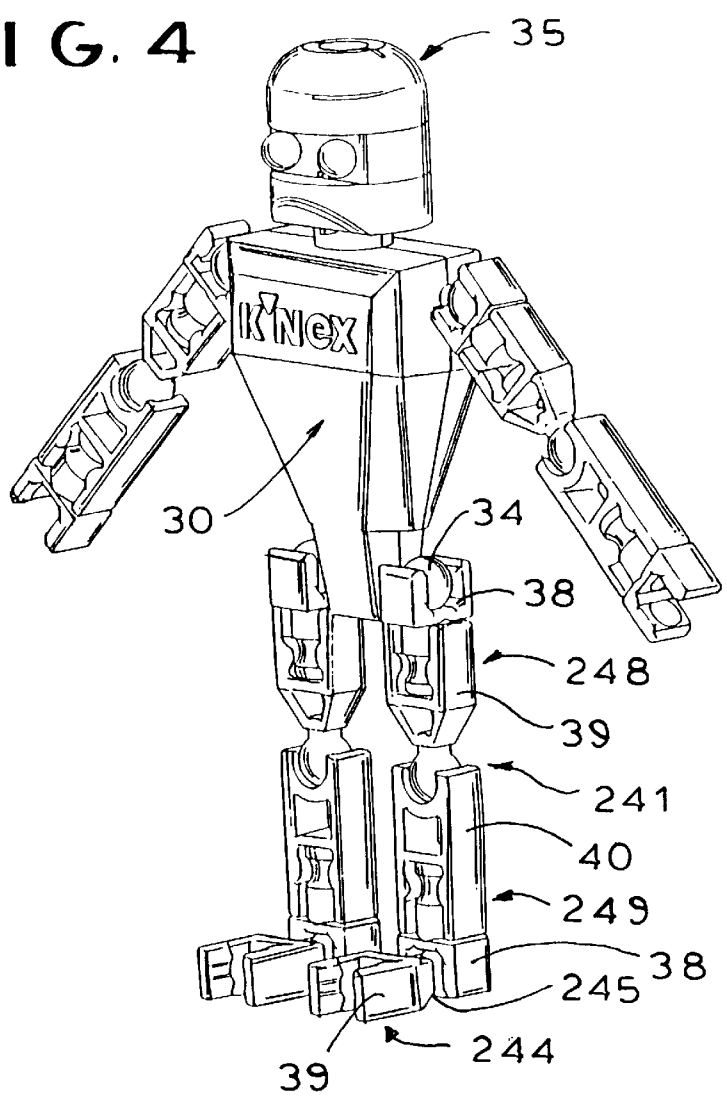
FIG. 4 is a front perspective view of a further modified form of sectional toy figure, assembled with a "short" configuration.

FIG. 4 shows the toy figure in a "short" configuration in which the leg assembly 241 is of shorter length than the assembly 141 of the figure of "medium" height, shown in FIG. 3. The upper leg portion 248 of FIG. 4, while being generally of the same length as the upper leg portion 148 of FIG. 3, is comprised of a terminal connector 38 joined with the hip-forming ball 34, and a ball connector 39 joined in axially aligned relation with the terminal connector 38. The lower leg portion 249 comprises a socket connector 40, joined at the knee with the ball connector 39 of the upper leg portion. A second terminal connector 38 is joined in axial alignment with the socket connector 40 to complete the lower leg portion, resulting in a lower leg length shorter than that of FIG. 3, as can be readily observed by comparison of FIGS. 3 and 4. A foot appendage 244 is provided by a ball connector 39, joined in a swivel connection with the terminal connector 38 to form an ankle joint 245.

As will be observed, in all of the above described configurations of the toy figure, the several leg assemblies are formed by the utilization of four standard component elements arranged in different orders and orientations. The arm assemblies likewise are formed of the same component elements, although the connecting rod 42 is not employed in the illustrated arm assemblies.

Figure 8:
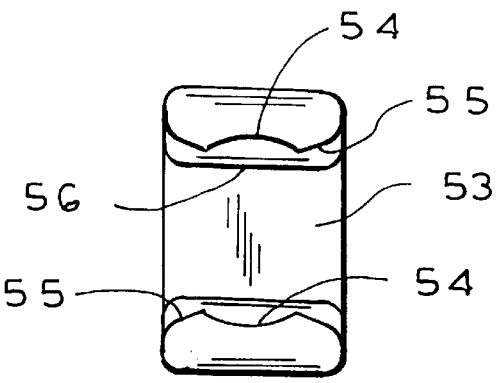
FIGS. 7 and 8 are top plan and end elevational views respectively of a socket connector element forming one of the basic limb-forming component parts of the sectional toy figure of the invention.
Figure 7:
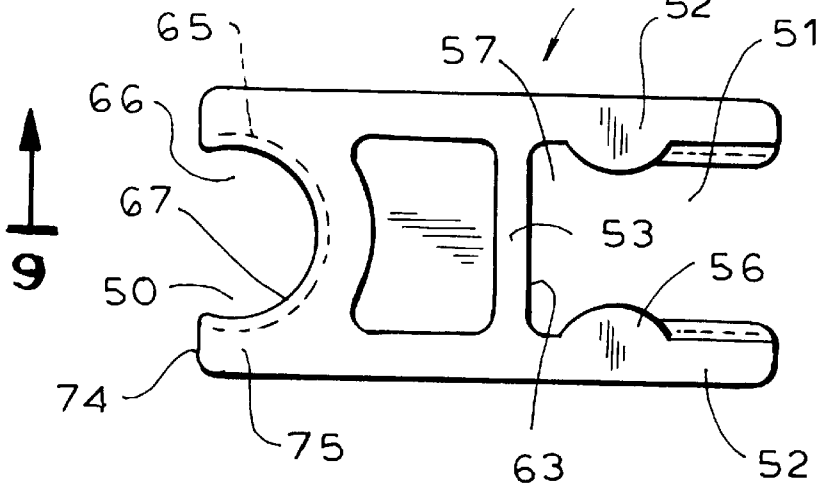
Figure 9:
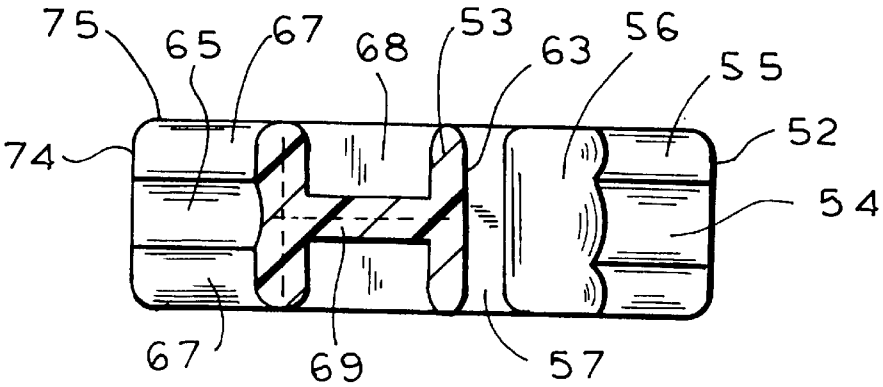
FIG. 9 is a cross sectional view as taken generally on line 9—9 of FIG. 7.

With reference now to FIGS. 7–9, illustrating details of the socket connector 40, the connector is shown to comprise a unitary plastic molding, configured to form a spherically shaped socket 50 at one end and an axially disposed rod socket 51 at the opposite end. The rod socket 51 is constructed in accordance with principles described in one or more of the beforementioned U.S. patents of K'NEX Industries, Inc., for example, U.S. Pat. No. 5,350,331. The rod socket comprises a pair of opposed gripping arms 52 and an end wall 53 forming an open-ended socket. Outer portions of the gripping arms are formed with partially cylindrical contours in their center portions 54 and inclined surfaces 55 on either side thereof. Spaced from the end wall 53 are opposed, transversely extending locking ribs 56 which, together with the end wall 53 form a constricted chamber 57 at the inner end of the socket.

The socket 51 is adapted for the lateral, snap-in assembly of a connecting rod 42 (FIG. 31) of a type shown in the beforementioned patents of K'NEX Industries, Inc. The connecting rod includes a short cylindrical center section 59, an annular groove 60 adjacent each end, and an end flange 61 at each end. The diameter of the cylindrical portion 59 is such as to have a close, frictionally snug fit with the cylindrical portions 54 of the socket 51, when positioned therein. The annular grooves 60 are of a size and shape to closely receive the transverse ribs 56, and the end flange 61 of the rod is snugly received within the constricted end chamber 57. To advantage, and as is known from the beforementioned patents, the axial dimensions of the end flange 61 may be very slightly greater than the corresponding dimensions of the constricted end chamber 57, such that the end surfaces 62 of the connecting rod are pressed tightly against the outwardly facing surface 63 of the end wall 53, when the connecting rod is received within the socket 51.

Assembly of the connecting rod 42 with the socket connector 40 is accomplished by lateral, snap-in assembly. The cylindrical center portion 59 of the connecting rod, when pressed against the inclined surfaces 55 of the socket outer portion, forces the opposed socket arms 52 outwardly, until the cylindrical portion 59 of the connecting rod snaps into the cylindrical portions 54 of the socket and becomes gripped therein in axial alignment with the body of the connector.

At the opposite end of the socket connector 40, the spherical socket 50 is formed by a spherically contoured groove 65, which extends around an arc somewhat greater than 180° for example, about 200° , defining an open end 66 of somewhat smaller dimensions than the diameter of the spherical contours of the groove. On each side of the spherically contoured groove 65 are generally cylindrical portions 67 of slightly smaller diameter forming restricted lateral openings to the spherical socket. In a typical and advantageous embodiment of the invention, the spherical portion of the socket may have a diameter on the order of 0.25 inch, for example, while the diameter of the cylindrical side portions 67 may be on the order of 0.226 inch. This both allows and requires a spherically contoured ball element, of a size to be snugly received in the spherical grooves 65, to be snapped into place, preferably by axial pressure against the restricted front opening of the spherical socket. Desirably, portions of the socket connector 40 between the end wall 53 and the surrounding walls of the spherical socket are recessed, as indicated at 68, to reduce weight and also material requirements, although preferably a central web 69 is provided for aesthetic purposes.

Figure 11:
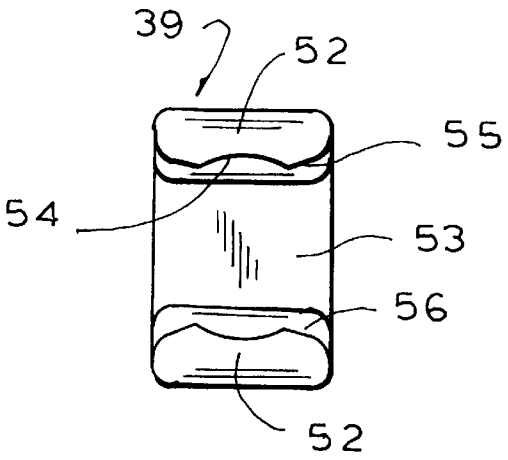
FIGS. 10 and 11 are top plan and end elevational views respectively of a ball connector element forming another of the basic limb-forming component parts of the sectional toy figure of the invention.
Figure 10:
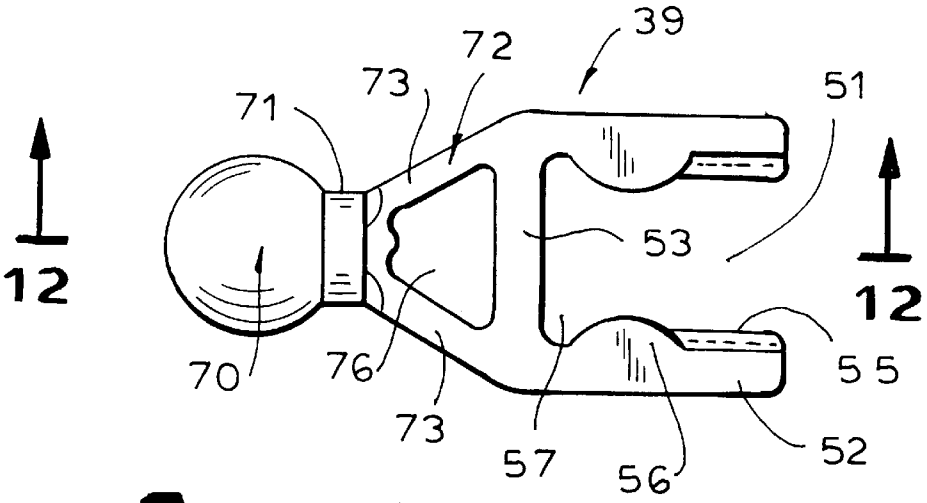
Figure 12:
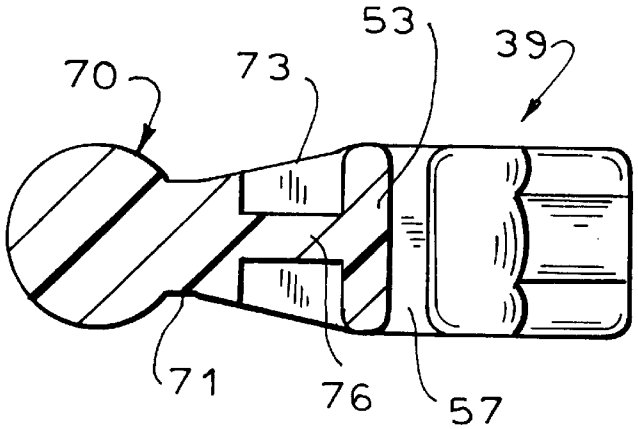
FIG. 12 is a cross sectional view as taken generally on line 12—12 of FIG. 10.

FIGS. 10–12 illustrate details of the ball connector element 39 incorporated in the toy figure of FIGS. 1–4. The ball connector includes a spherical element 70 at one end and a rod socket 51 at the other. The rod socket 51 is in all respects similar to the rod socket 51 of the previously described socket connector 40, and need not be described further herein.

Figure 16:
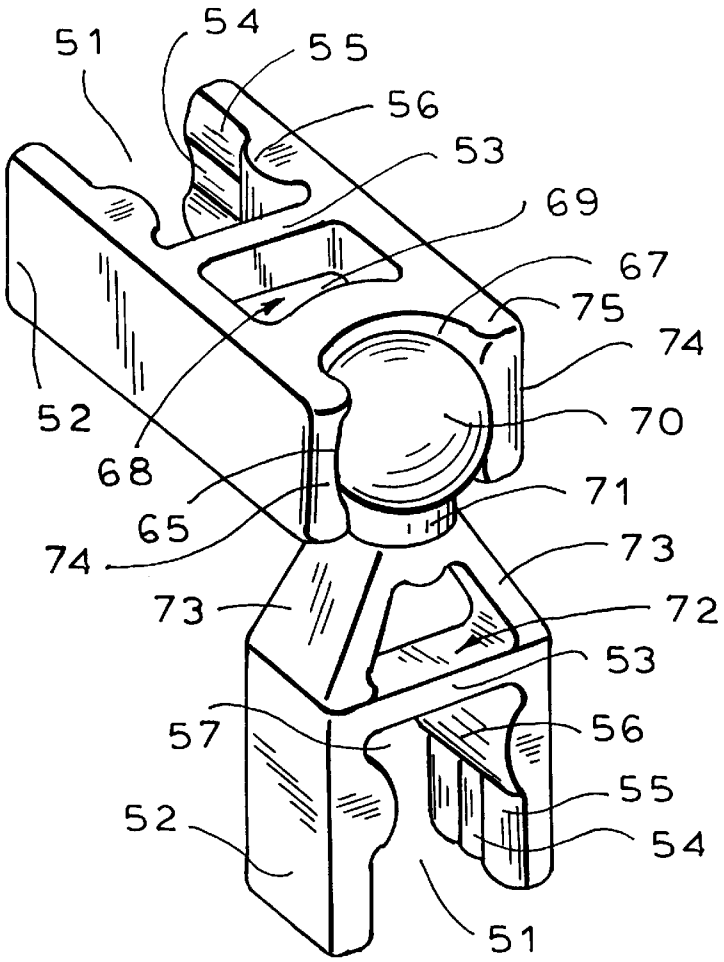
FIG. 16 is a perspective view illustrating an assembled pair of ball and socket connectors.

The ball element 70 is of spherical contour, joined by a neck 71 to a tapered end portion 72, which joins with the socket portion 51 at the end wall 53 thereof. The diameter of the ball element is such as to provide a slight interference fit in the socket portion 50 of the socket connector 40. The size and location of the neck portion 71 is such that the ball element 70 comprises a substantial portion of a sphere. For example, the diameter of the neck portion 71 may be on the order of 0.155 inch compared with a diameter of approximately 0.256 inch for the ball 70 itself. The tapered connecting portion 72 consists of converging sidewalls 73, which are also tapered in thickness, as shown in FIG. 12, such that the walls 73 converge and merge with the neck portion 71. The arrangement is such that, when a ball connector and socket connector are assembled, as shown in FIG. 16 of the drawing, the two connectors may be rotated relative to each other and also, when oriented such that the ball connector is aligned with an open side of the socket 50 of the socket connector, as shown in FIG. 16, the two connectors may be pivoted far enough to enable them to be disposed at an acute angle relative to each other. When the ball connector is pivoted in the direction of a closed side of the socket connector, the two connector elements may be pivoted to an angle of about 135° , until the end extremities 74 of the socket-forming portion 75 of the socket connector engage the neck 71 of the ball connector.

Preferably, a thin web 76 (see FIG. 12) closes the open area defined by the tapered walls 73 and the end wall 53, principally for aesthetic purposes.

Figure 14:
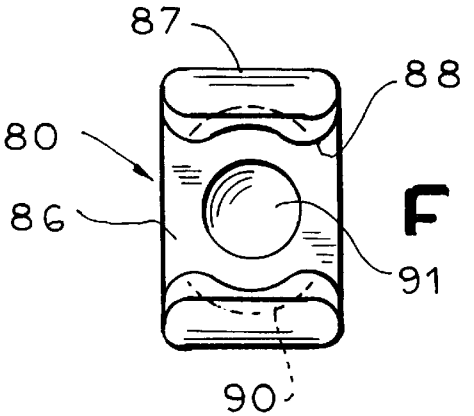
FIGS. 13 and 14 are top plan and end elevational views respectively of a socket connector element forming another of the limb-forming component parts of the sectional toy figure of the invention.
Figure 13:
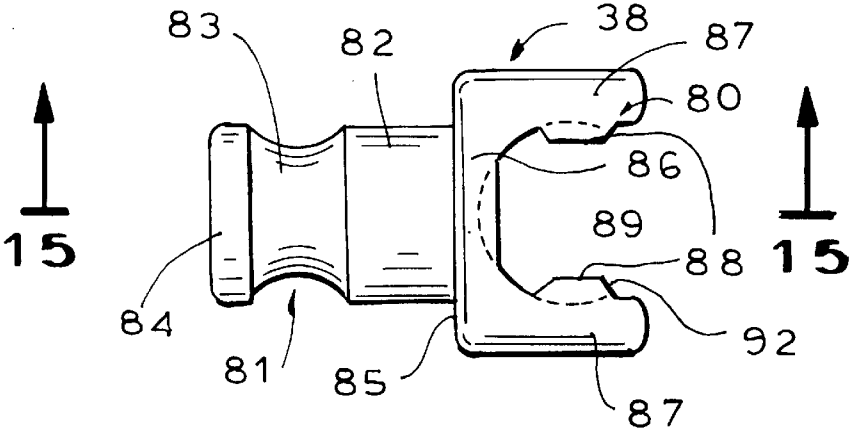
Figure 15:
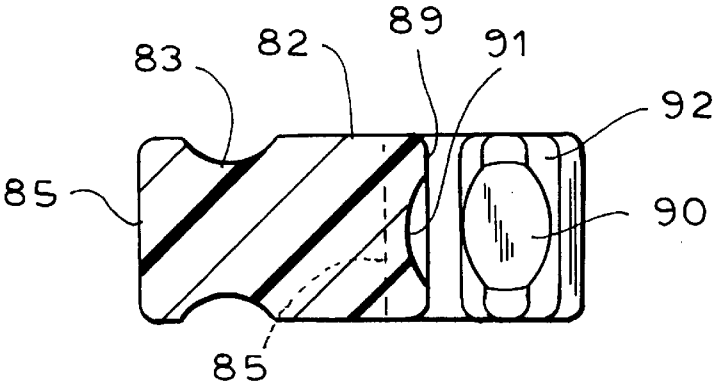
FIG. 15 is a cross sectional view as taken generally on line 15—15 of FIG. 13.
Figure 31:
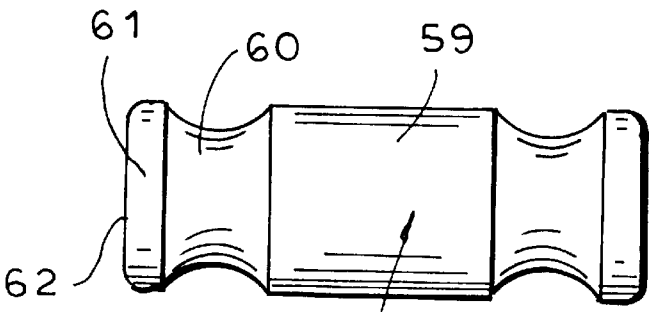
FIG. 31 is a side elevational view of a connecting rod utilized in the toy figure of the invention.

FIGS. 13–15 show details of the terminal connector 38, which is formed with a socket end 80 and a rod end 81. The rod end 81 is essentially one-half of the connector rod element 42, as shown in FIG. 31. It consists of a cylindrical section 82, an annular groove 83 and an end flange portion 84. The cylindrical portion 82 is half the length of the cylindrical portion 59 of the rod connector shown in FIG. 31 and is joined integrally with a flat end surface 85 of the socket portion 80.

The socket portion 80 of the terminal connector comprises an end wall 86 and opposed gripping arms 87. In a preferred form of the invention, the socket portion 80 is formed with a pair of laterally opposed gripping pads 88, formed integrally with the gripping arms 87, and a third gripping pad 89, which is integral with the back wall 86. The three gripping pads 88, 89 are spherically recessed as shown at 90 (for the laterally opposed pads 88) and 91 (for the end pad 89). The spherically contoured recesses form in effect a portion of a sphere greater than one-half, such that a ball element 70 of a ball connector 39, or 32, 34 of the torso member 30, must be forced into a position to be engaged and gripped by the gripping pads 88, 89. To this end, the outer portions 92 of the laterally opposed gripping pads 88 are disposed at an angle to serve in a wedging capacity, to resiliently separate the gripping arms 87 when a spherical ball is pressed into the socket portion from the open outer end thereof. Once snapped into place, a spherical ball element is frictionally gripped and retained by the gripping pads 88, 89 with freedom to rotate and pivot to a variety of positions and frictionally retained therein by a snug grip between the pads 88, 89 and a spherical ball element retained therein.

The terminal connector 38 may be incorporated in the structure of the toy figure in a variety of ways. In the arm assemblies 37 shown in FIGS. 1–4, the socket portions of the terminal connectors are joined in a swivel connection with the shoulder balls 32, while the rod ends 81 of the terminal connectors are joined in axial alignment with a ball connector 39, being received in the rod socket thereof in the manner previously described. At the outer end of the arm assembly, a second terminal connector 38 has its rod end 81 assembled with the rod socket 51 of a socket connector, emulating a hand.

In the toy figure constructed in accordance with FIG. 3, the upper end of the leg assembly 148 comprises a terminal connector 38, joined with a ball 34 to form a swiveling hip joint The rod end of this connector is joined in axial alignment with the rod socket of a socket connector 40, with the socket connector being rotatable with respect to the axis of the rod section but otherwise retained in axial alignment with the terminal connector.

In the "short" version of the toy assembly shown in FIG. 4, terminal connectors 38 are provided at both the top and the bottom of the leg assembly 241.

Figure 17:
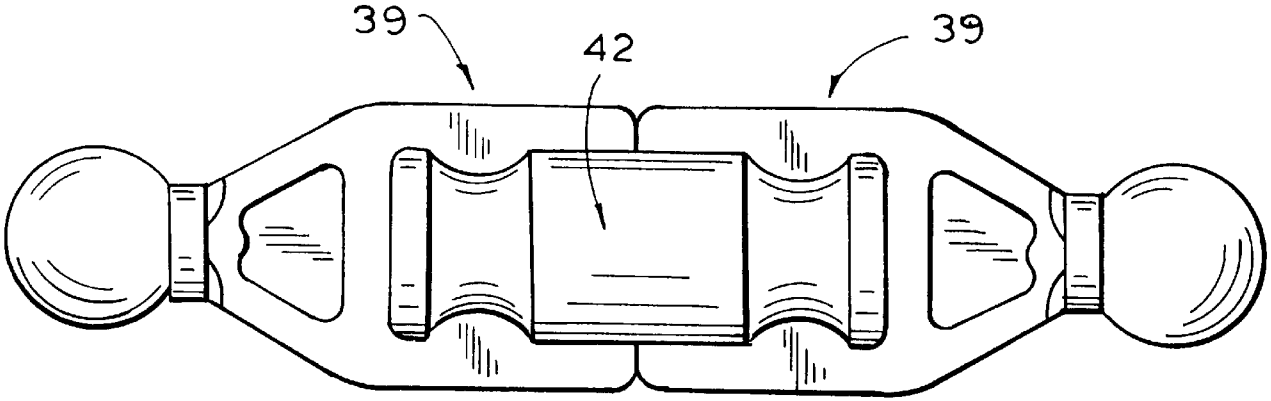
FIG. 17 is a plan view of an assembly of two ball connectors, joined end to end in axial alignment by means of a connector rod element.
Figure 18:
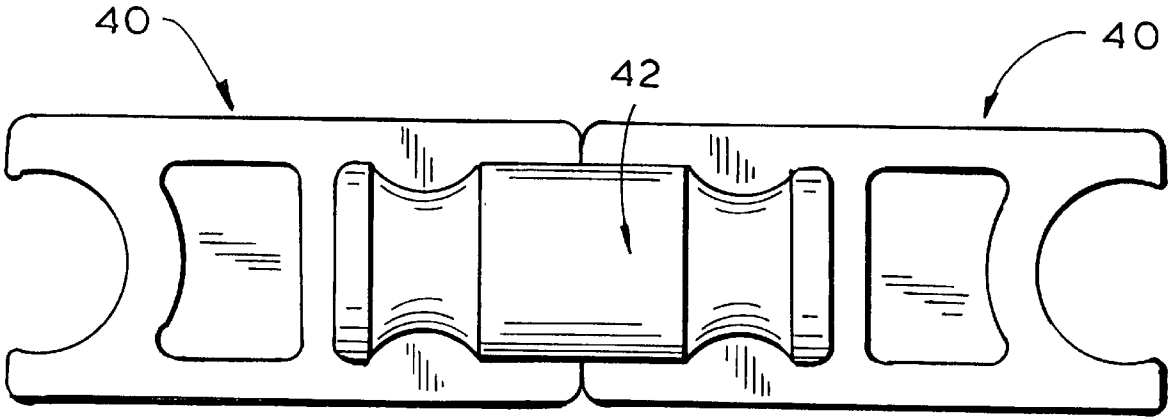
FIG. 18 is a plan view, similar to FIG. 17, illustrating a pair of socket connectors joined end to end by a connector rod element.
Figure 19:
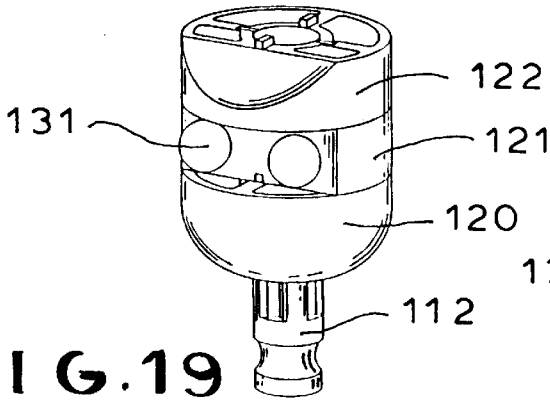
FIGS. 19–24 are perspective views illustrating a variety of head configurations for the sectional toy figure of the invention, that may be assembled utilizing three primary sectional elements of the head assembly.
Figure 20:
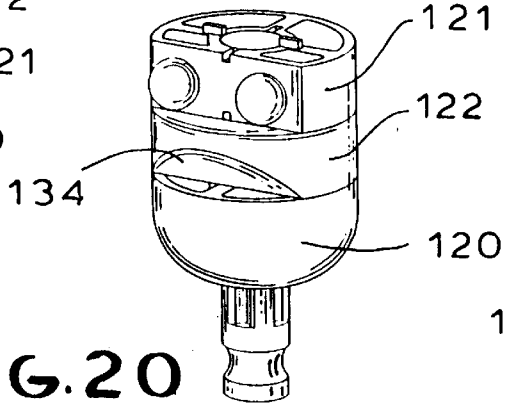
Figure 21:
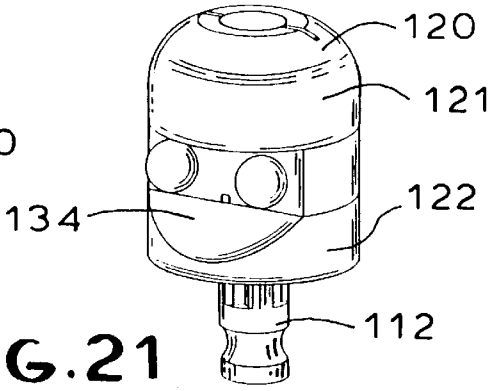
Figure 22:
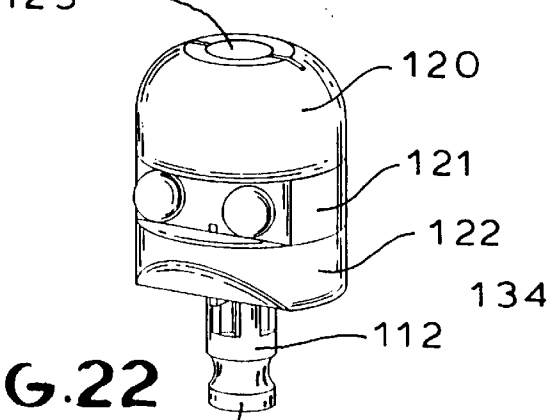
Figure 23:
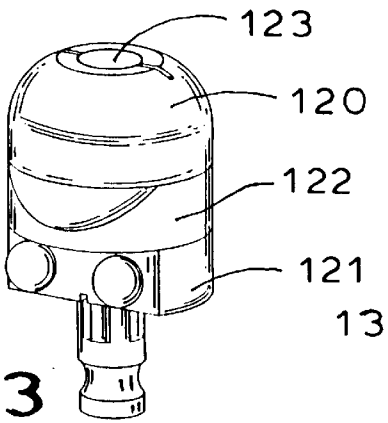
Figure 24:
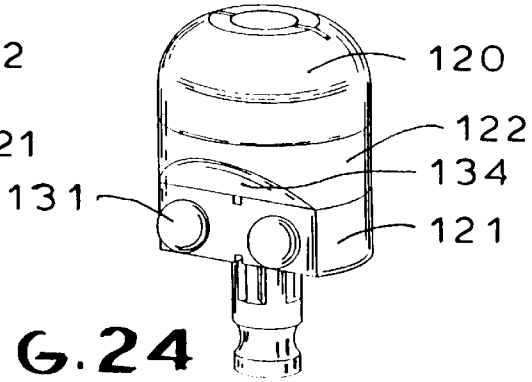

As a particularly advantageous feature of the invention, the ball connectors 39 and the socket connectors 40 may be connected in aligned pairs, as shown in FIGS. 17, 18, or in a mixed pair, as in the lower leg portion 49 of FIG. 1. In either case, two of the connector elements, whether 39—39, 40—40 or 39–40, are joined in end-to-end abutting relation by a connecting rod 42, which secures the respective elements in axially aligned relation, while permitting relative rotation about the axis. As shown in FIGS. 1 and 2, for example, a pair of joined connectors may be rotationally oriented at 90° , as shown in the upper leg portion 41, or in the same orientation, as shown in the lower leg portion 49, for different visual effects. In either case, the respective connectors are retained rigidly in axial alignment by means of the connecting rods 58, while providing for universal swiveling action by ball and socket elements at opposite ends.

Figure 5:
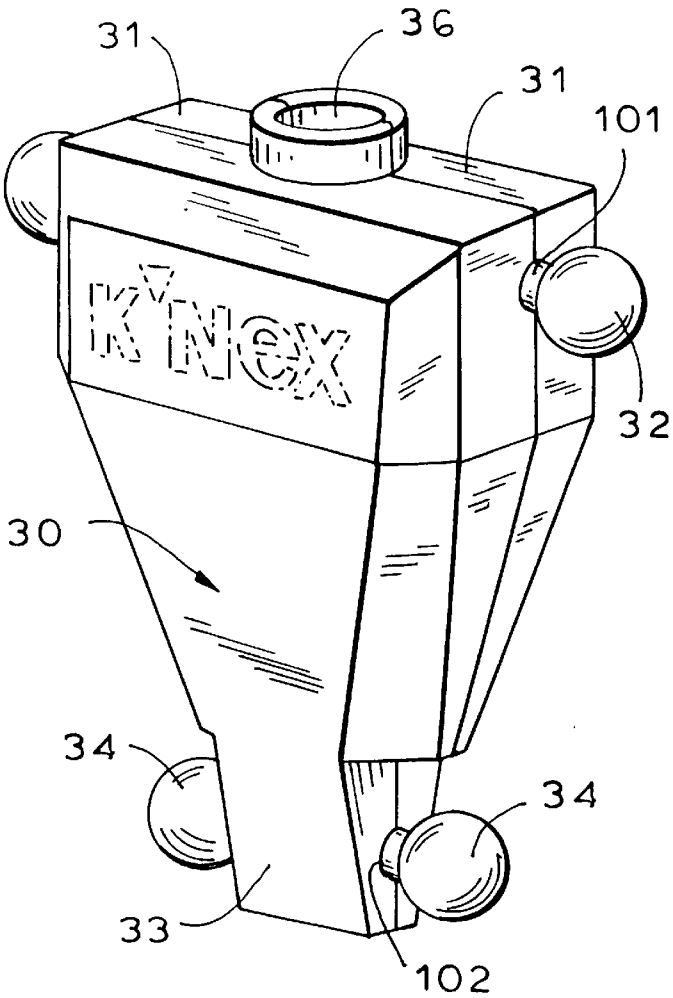
FIG. 5 is an enlarged perspective view of a torso element advantageously incorporated in the sectional toy assembly of FIG. 1.
Figure 6:
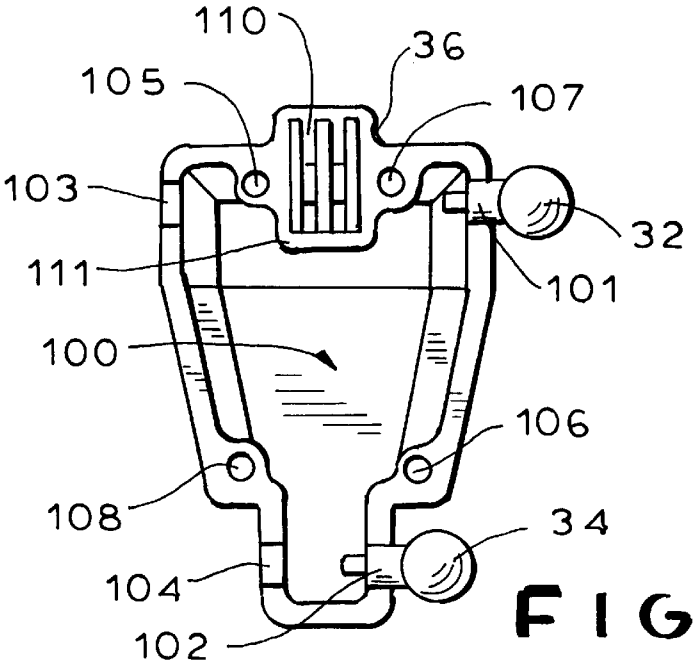
FIG. 6 is a plan view illustrating details of construction of a molded half section forming a component part of the torso element of FIG. 5.

The torso or body member 30, shown best in FIGS. 5 and 6, preferably is comprised of symmetrical half sections 100 (FIG. 6), each provided at one side with joint-forming balls 32, 34. The balls 32, 34 are mounted on cylindrical necks 101, 102 of smaller diameter than the balls themselves, to allow for a range of swiveling movement at the body joints. Cylindrical recesses 103, 104 are formed at the opposite side of the body half section 100, so that when two sections are assembled face-to-face, the ball-mounting necks 101, 102 of one section are received in the recesses 103, 104 of the opposing section. Locating pins 105, 106 are arranged to be received in corresponding recesses 107, 108 in an opposed body half, providing for precise alignment of the assembled parts, as well as a desirable level of friction to retain the parts in assembled relation. If desired, the two body halves 100 may be adhesively or otherwise bonded.

At the top of each body section there is formed a semi-cylindrical neck support recess 110, which is closed at the bottom 111 and is arranged to receive and frictionally grip the end portion of a connecting rod 112 (FIGS. 19–24) for mounting of a head assembly.

Pursuant to one aspect of the invention, the head structure of the toy figure is comprised of a plurality of layered head-forming sections, which are arranged to be assembled in a variety of orders and orientations to enable assembly of heads in a variety of designs. With reference to FIGS. 19–30, an initially to FIG. 22, a "standard" head assembly may comprise an upper section 120, a central section 121, and a lower section 122, all having generally cylindrical external contours of approximately the same diameter and all provided with a central opening for the reception of a connecting rod 112. The connecting rod may be any cylindrical rod, but advantageously is a standard rod of appropriate length from a K'INEX construction set marketed by K'NEX Industries, Inc. The length of the connecting rod 112 is such that when the several head-forming elements 120–122 are assembled thereon, with the upper end 123 of the rod generally flush with the top of the uppermost head-forming section, the lower end 124 of the rod projects downward for a distance approximately equal to the depth of the neck supporting recess 110 of the torso or body section 30. Thus, the bottom of the head assembly typically rests on the top of the neck portion collar 36.

As is evident in FIGS. 19–24, the head-forming sections 120–122 may be assembled in a variety of orders and orientations to achieve a variety of head design configurations, of which FIGS. 19–24 are representative but not all inclusive. Thus, the terms "upper", "intermediate" and "lower", used in referring to the several head sections, are for convenience and their usage does not imply that the several sections are always assembled in such locations.

Figure 26:
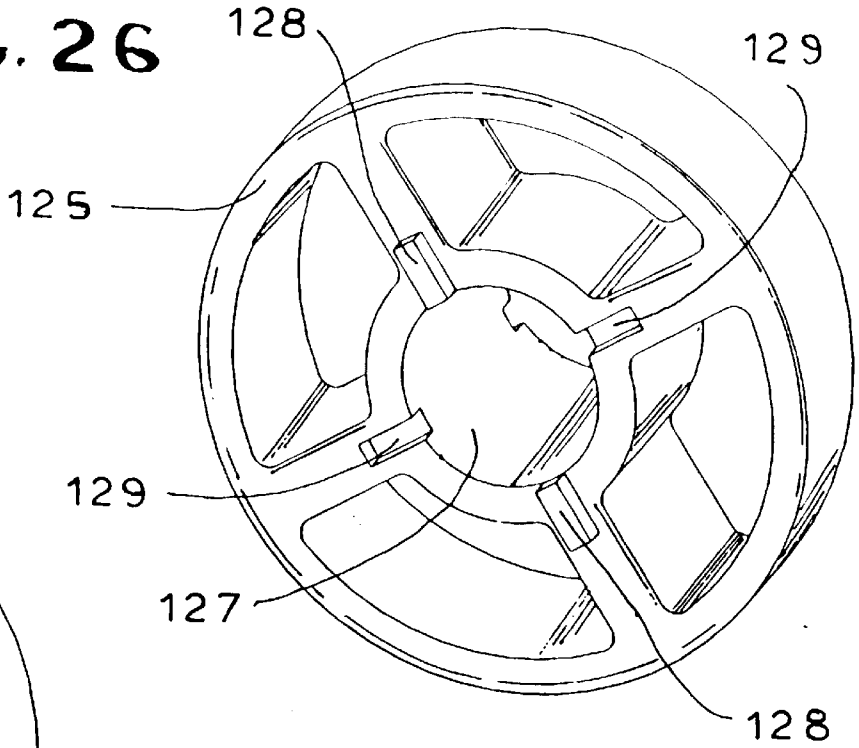
FIGS. 25 and 26 are top and bottom perspective views respectively of a first sectional element of the head assembly.
Figure 25:
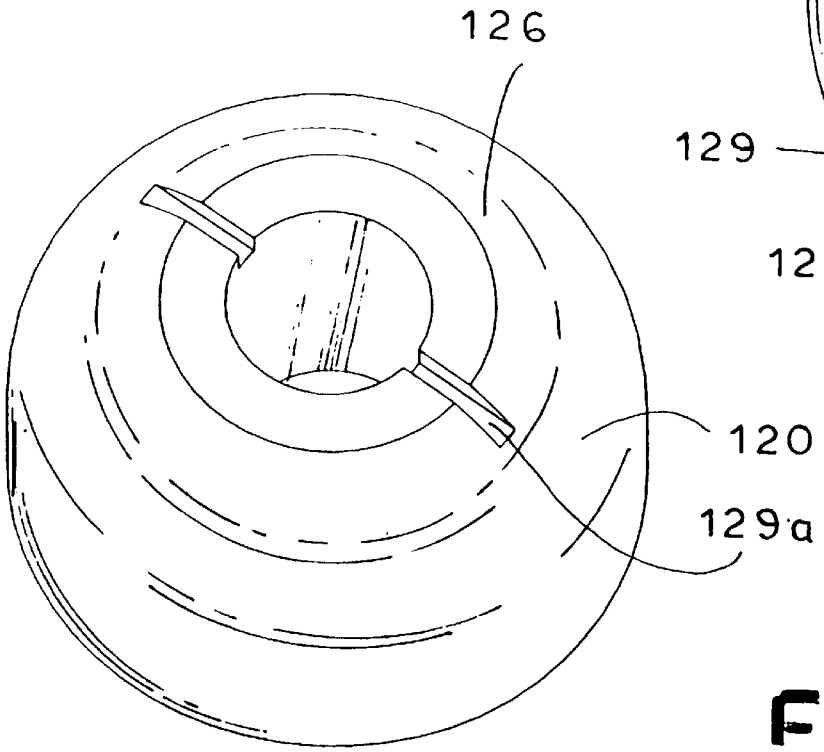

The "upper" head-forming section 120 is shown in FIGS. 25 and 26. It is of generally circular cross section, flat on the bottom surface 125 and of somewhat semi-spherical contours in the upper portions 126. A cylindrical opening 127 is provided for the reception of the connecting rod 112. Molded integrally with the bottom surface of the section 120 are diametrically opposed key lugs 128 and a pair of diametrically opposed lug-receiving recesses 129. Recesses 129*a* are also formed on the upper surface of the section 120.

Figure 28:
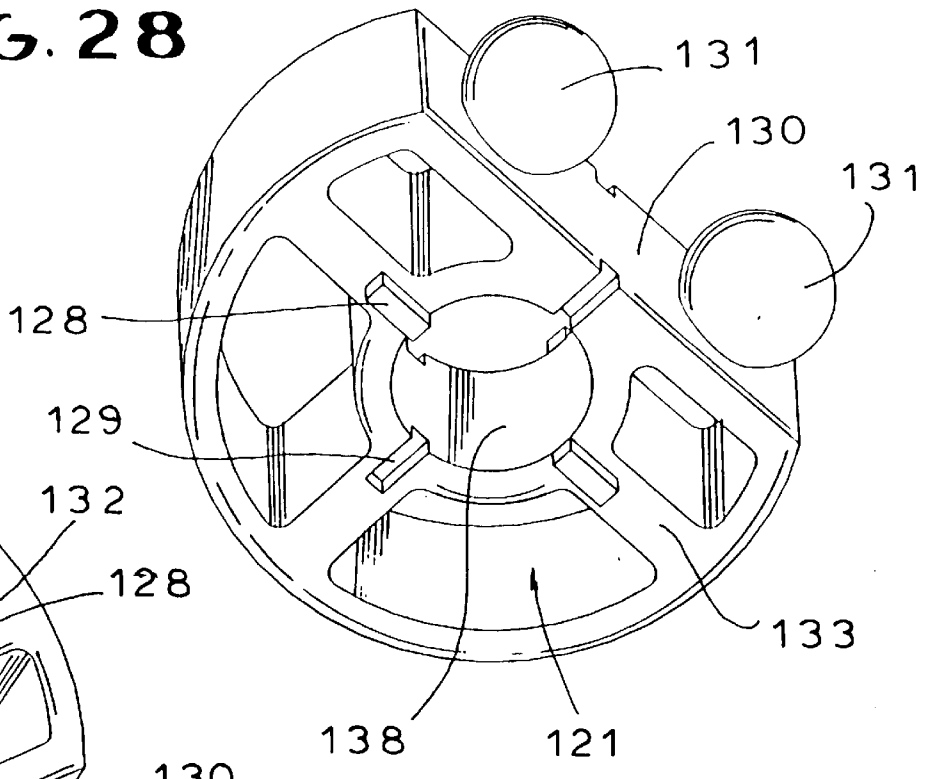
FIGS. 27 and 28 are top and bottom perspective views respectively of a second sectional element of the head assembly provided with spherical elements representing eyes.
Figure 27:
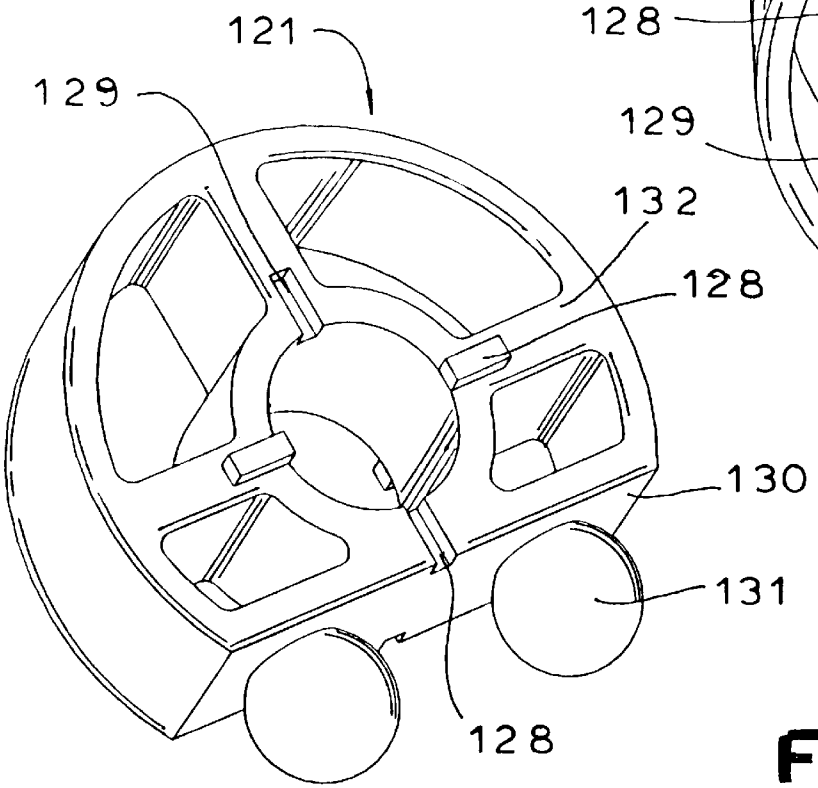
Figure 30:
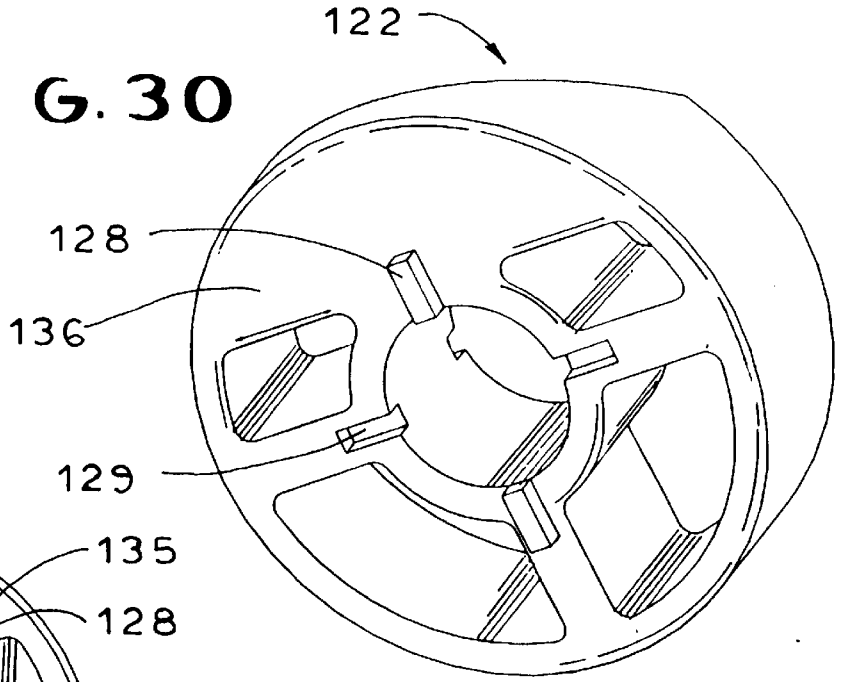
FIGS. 29 and 30 are top and bottom perspective views respectively of a third sectional element of the head assembly.
Figure 29:
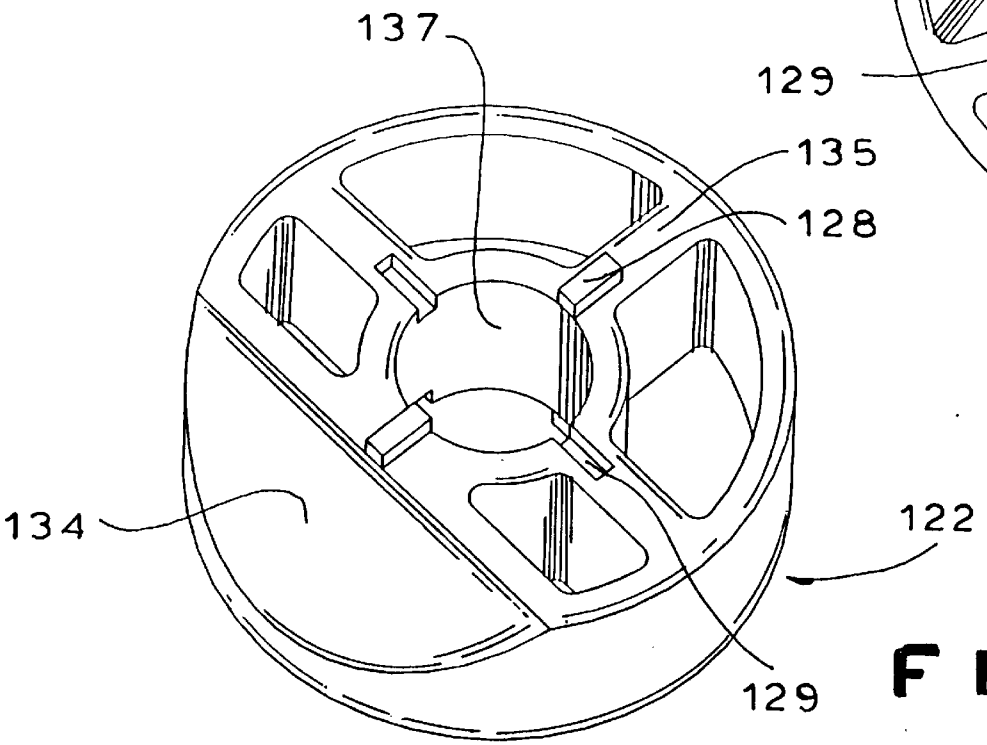

The "intermediate" head-forming section, shown in FIGS. 27 and 28, is of generally circular cross section, but flat across a front surface 130, which mounts a pair of spaced spheres 131 representing eyes. In the illustrated form, the intermediate head-forming section 121 is formed with flat top and bottom surfaces 132, 133, each provided with diametrically opposed key lugs 128 and recesses 129. A central opening 138 is provided for the snug reception of the connecting rod 112.

The "lower" head-forming section 122 preferably is of cylindrical configuration but provided along one side with an angularly receding surface 134 which, as will appear, can be oriented to form a chin or a mouth in the various head assemblies. The head-forming section 122 is formed with flat upper and lower surfaces 135, 136 each provided with opposed lugs and recesses 128 and 129 as in the other head-forming sections, and a central cylindrical opening 137 for reception of the connecting rod 112.

As is evident in FIGS. 19–24, the various head-forming sections can be mounted either "right-side up" or "upside down" on the connecting rod 112, and they may be placed in any order on the connecting rod. When the head-forming elements are mounted on the connecting rod, the respective key lugs 128 and recesses 129 of adjacent parts are mated to provide for a desired rotational orientation of the respective parts.

The toy sectional figure of the present invention enables a wide variety of configurations to be assembled using a relatively minimum number of standardized parts and thus minimizing the costs of producing and marketing the device. To particular advantage, the several limb-forming components can be assembled in a wide variety of forms, with particular advantage being derived from the ability to connect two ball connectors, two socket connectors or a socket connector and a ball connector, in an axially aligned relation. This provides significantly greater flexibility in the assembly of toy figures, as compared to more typical sets designed for this purpose, where each connection is a swivel joint.

With a kit containing a relative minimum number of parts, an extraordinary variety of forms may be assembled, providing a maximum degree of interest retention in a relatively simplified and minimal kit of parts.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A sectional toy figure having articulate limbs with detachable elements, the toy comprising:

(a) a body having a joint-forming ball, and a limb attached to said ball, said limb including first and second connector elements;

(b) said first connector element having first and second ends aligned along an axis, and having a ball socket on said first end and a post extending from said second end;

(c) said ball socket being defined by a first pair of opposed, spaced-apart gripping arms and an end wall, said first pair of gripping arms each having an integral gripping pad with a partially-spherical recess sized and shaped to retain said ball, said ball being removably insertable in said ball socket, in a snap-fit assembly, and said first connector being easily detachable from said ball;

(d) said post of said first connector element extending outwardly from said end wall of said ball socket, said post including a substantially cylindrical base portion, an annular groove portion and an end flange;

(e) said second connector having a second pair of opposed integral, outwardly-extending and spaced-apart gripping arms and an end wall, forming an open-ended socket, outer portions of said second pair of gripping arms having partially cylindrical contours in center portions thereof and having inclined surfaces on either side thereof, an intermediate portion of said second pair of gripping arms having opposed, transversely-extending locking ribs, said second pair of gripping arms being sized and shaped to connect to said rod segment in a lateral, snap-fit assembly;

(f) said partially cylindrical contours of said second pair of gripping arms closely receiving said substantially cylindrical base portion of said post to maintain said post in axial alignment with said second connector, and said locking ribs extending into said annular groove in said post to maintain said post in mechanical locking engagement against axial movement with respect to said second connector; and (g) said second pair of gripping arms substantially abutting said end wall of said ball socket of said first connector, and permitting substantially unrestrained rotation of said first connector about said axis thereof.

2. A sectional toy figure according to claim 1, wherein:

(a) said second connector has first and second ends, said gripping arms of said second connector being located on said first end;

(b) said second connector having a ball socket on said second end; and (c) said ball socket of said second connector comprising an opposed pair of gripping arms and an interior wall, and comprising a groove in said opposed arms and said interior wall.

3. A sectional toy figure as in claim 2, further comprising:

(a) a third connector having first and second ends, and having a ball on said first end thereof engageable with said ball socket of said second connector, said ball of said third connector being easily detachable from said second connector;

(b) said third connector having a pair of opposed gripping arms on said second end thereof; and (c) a rod releasably engageable with said gripping arms of said third connector.

4. A sectional toy figure as in claim 1, wherein:

(a) said second connector has first and second ends, said gripping arms of said second connector being located on said first end;

(b) said second connector having a ball on said second end; and (c) a third connector having a ball socket engageable with said ball of said second connector, said ball socket of said third connector being easily detachable from said ball of said second socket.

5. A sectional toy figure as in claim 4, wherein:

(a) said third connector has first and second ends, said ball socket of said third connector being on said first end; and (b) said third connector has a pair of gripping arms located on said second end.

* * * * *